US006929557B2

(12) United States Patent
Chou

(10) Patent No.: US 6,929,557 B2
(45) Date of Patent: Aug. 16, 2005

(54) GOLF PUTTING TEACHING DEVICE

(76) Inventor: Jason Chou, No. 354, Sec. 2, Yon Pin Rd., Taiping City (TW)

( * ) Notice: Subject to any disclaimer, the term of this patent is extended or adjusted under 35 U.S.C. 154(b) by 11 days.

(21) Appl. No.: 10/723,394

(22) Filed: Nov. 24, 2003

(65) Prior Publication Data

US 2004/0137996 A1 Jul. 15, 2004

(30) Foreign Application Priority Data

Jan. 10, 2003 (CN) ..... 03228125 U

(51) Int. Cl.[7] ..... A63B 69/36
(52) U.S. Cl. ..... 473/198; 473/225
(58) Field of Search ..... 473/198, 199, 473/219, 220, 221, 222, 225, 278

(56) References Cited

U.S. PATENT DOCUMENTS 3,727,069 A * 4/1973 Crittenden et al. ..... 250/222.1
4,770,527 A * 9/1988 Park ..... 356/28
4,872,687 A * 10/1989 Dooley ..... 473/152
5,230,505 A * 7/1993 Paquet et al. ..... 473/455
5,435,547 A * 7/1995 Lee ..... 473/225
5,626,526 A * 5/1997 Pao et al. ..... 473/156
5,733,200 A * 3/1998 Kim ..... 473/161
5,779,241 A * 7/1998 D'Costa et al. ..... 273/371
6,540,620 B1 * 4/2003 Consiglio ..... 473/150
6,669,574 B1 * 12/2003 Riley et al. ..... 473/264
6,709,343 B1 * 3/2004 O'Connor et al. ..... 473/265
6,821,211 B2 * 11/2004 Otten et al. ..... 473/219

* cited by examiner

*Primary Examiner*—Gregory Vidovich
*Assistant Examiner*—Nini F. Legesse
(74) *Attorney, Agent, or Firm*—Charles E. Baxley

(57) ABSTRACT

A golf putting teaching device includes a path with two side walls and each side walls has a plurality of first sensors on an inside thereof. An end piece has a top board and two side portions. The end piece is mounted across two sides of the path and a plurality of second sensors are located on an underside of the top board. The first sensors in the side walls are electronically connected to the second sensors of the top board. A controlling device is connected to one of the tow side portions and electronically connected to the first and the second sensors so as to process the data collected from the first and the second sensors to display the direction, speed, distance, and other necessary information for each putting.

5 Claims, 7 Drawing Sheets

GOLF PUTTING TEACHING DEVICE

FIELD OF THE INVENTION

The present invention relates to a golf putting device that includes a plurality of first sensors on two side walls along a path and second sensors located at the end of the path so as to display the direction and speed.

BACKGROUND OF THE INVENTION

A conventional golf teaching device is shown in FIG. 1 and generally includes a base 1 on which a swinging device 2 is connected which includes a bar with a ball fixed to a distal end thereof so that a player drives the ball by swinging a golf club. A display device 3 is located beside the swinging device 2 so as to display the speed and/or distance of the ball flies. A direction indicator 4 is electrically connected to the swinging device 2 and includes several detection members 5 so as to detect the direction and the ballistic of the ball. The direction and the ballistic are shown by the indicators 6 on the direction indicator 4. Nevertheless, this is not used for putting which requires more precise and skill to control the direction and distance of the ball.

The present invention intends to provide a putting teaching device that has first sensors on two side walls along the path and second sensors on a top board at the end of the path so as to have complete information of the movement of the ball and to display these data to the players.

SUMMARY OF THE INVENTION

The present invention relates to a golf putting teaching device which comprises a path and two side walls are located on two sides of the path and each side walls has a plurality of first sensors on an inside thereof. An end piece has a top board and two side portions and the end piece mounted across two sides of the path. A plurality of second sensors are located on an underside of the top board and the first sensors in the side walls are electronically connected to the second sensors of the top board.

The primary object of the present invention is to provide a putting teaching device that senses the direction and speed of the ball so as to provide the result of the putting to the players.

The present invention will become m ore obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
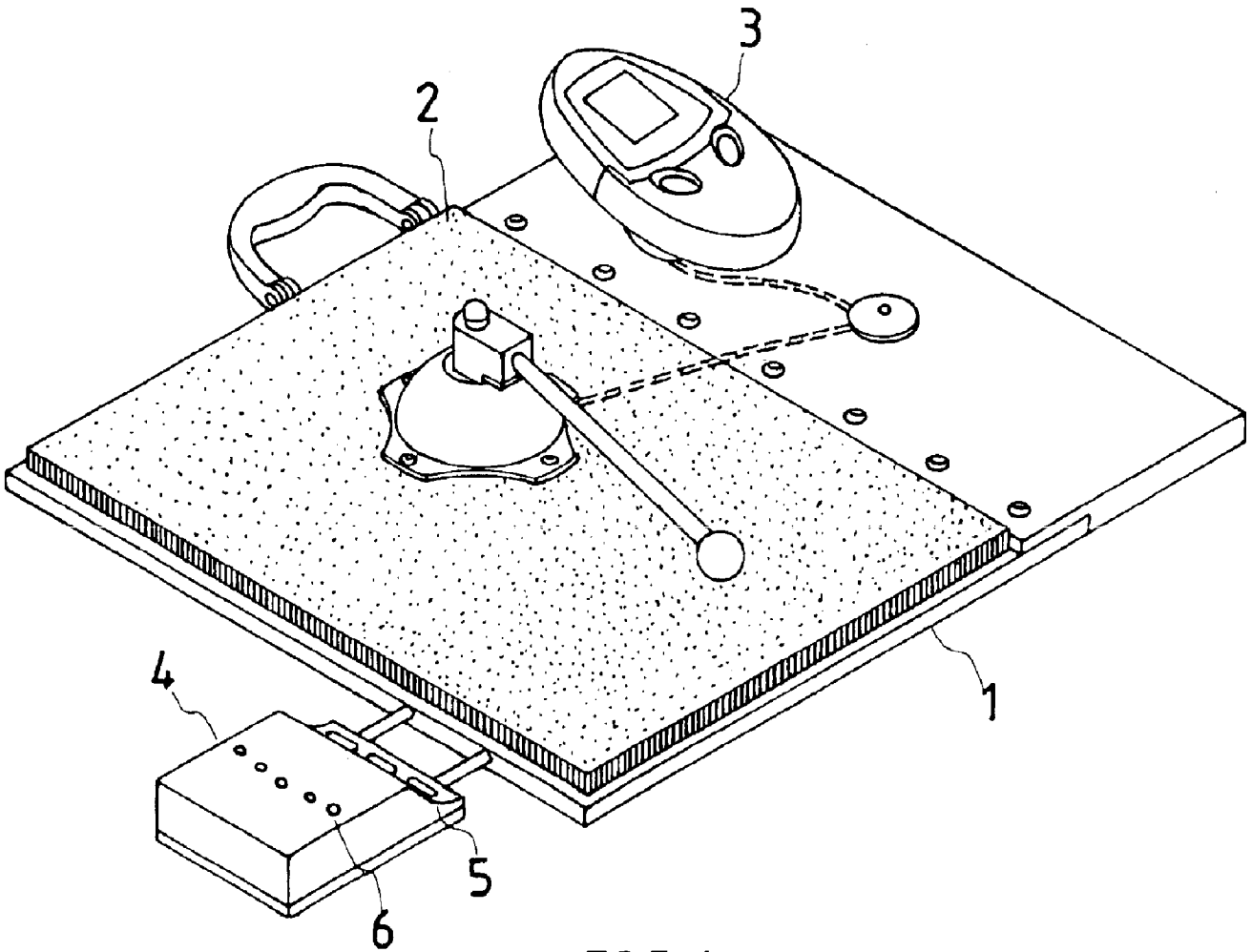
FIG 1 PRIOR ART
FIG. 1 is a perspective view to show a conventional golf swinging device.
Figure 2:
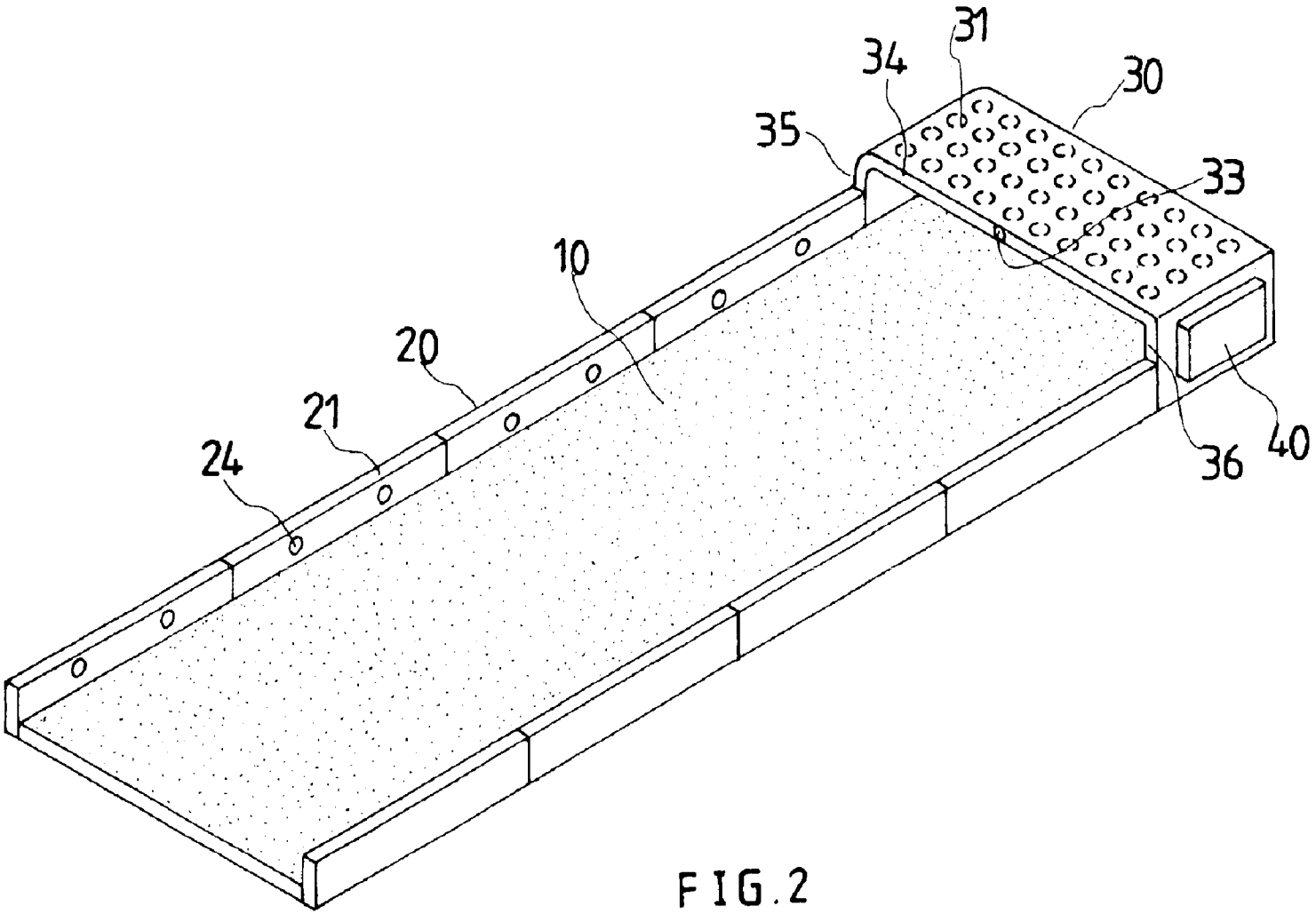
FIG. 2 is a perspective view to show the golf putting teaching device of the present invention.
Figure 3:
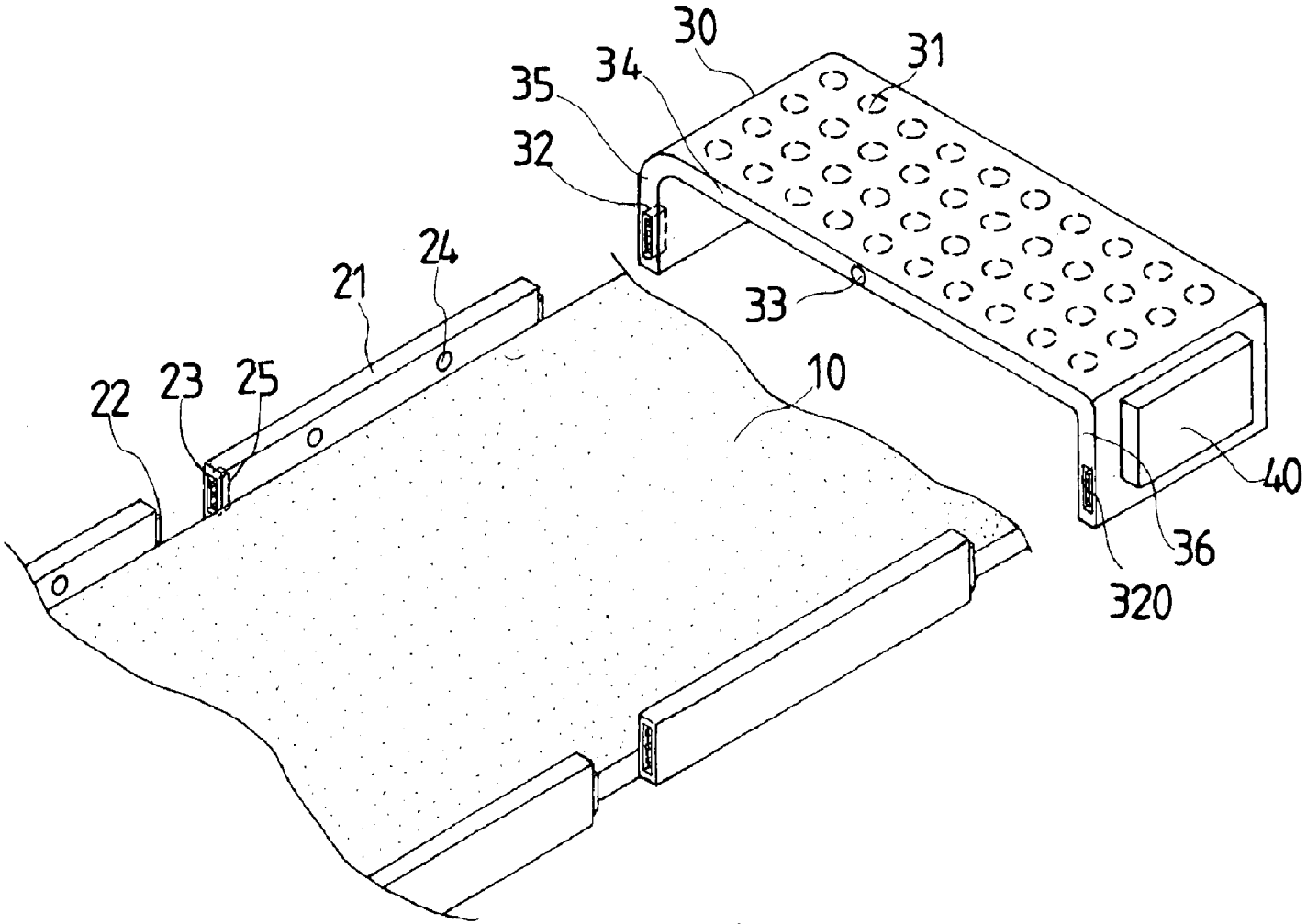
FIG. 3 is an exploded view to show the two side walls, the piece and the end piece of the golf putting teaching device of the present invention.
Figure 4:
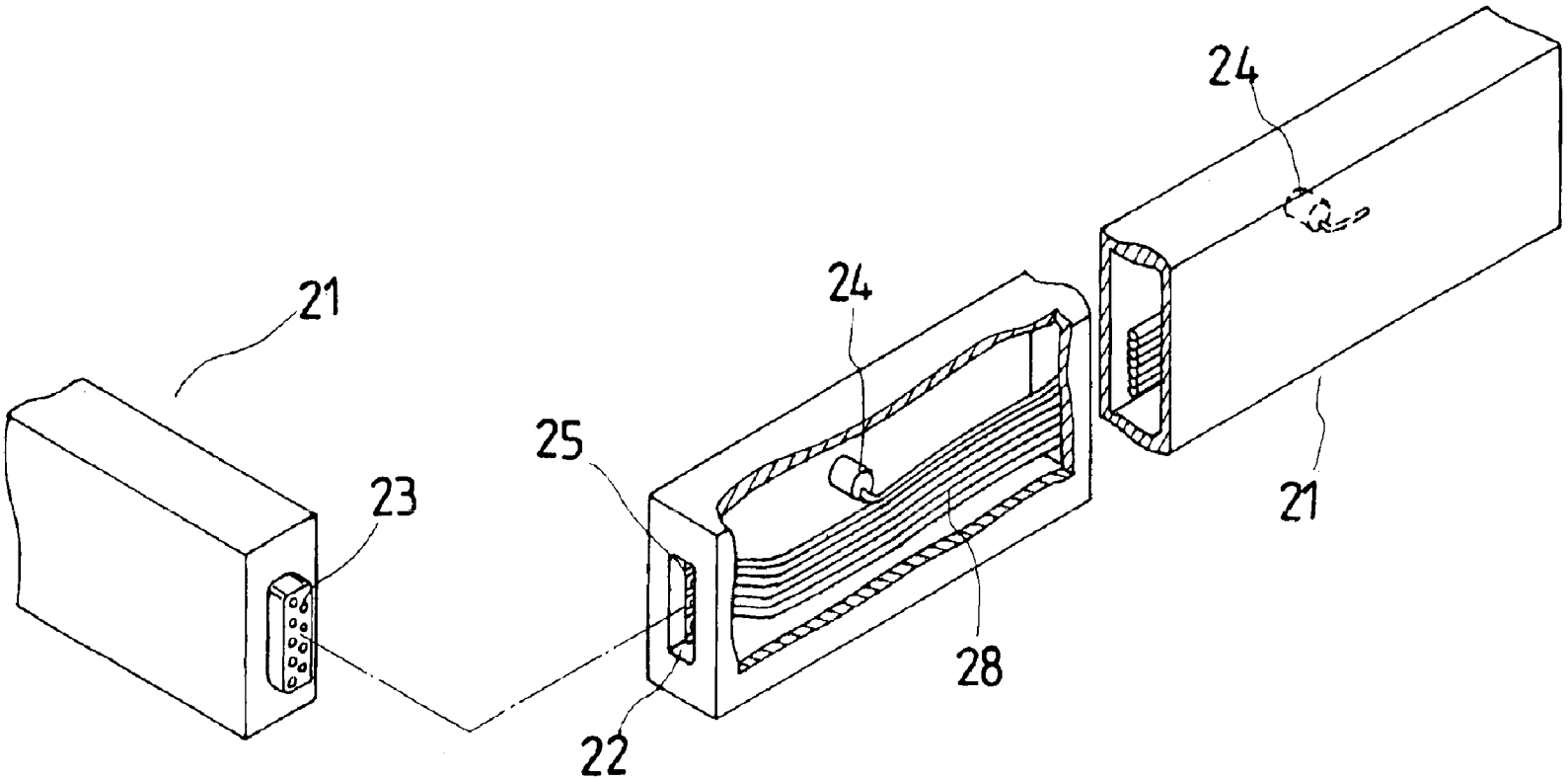
FIG. 4 is an exploded view to show the sections of each of the two side walls of the present invention.
Figure 5:
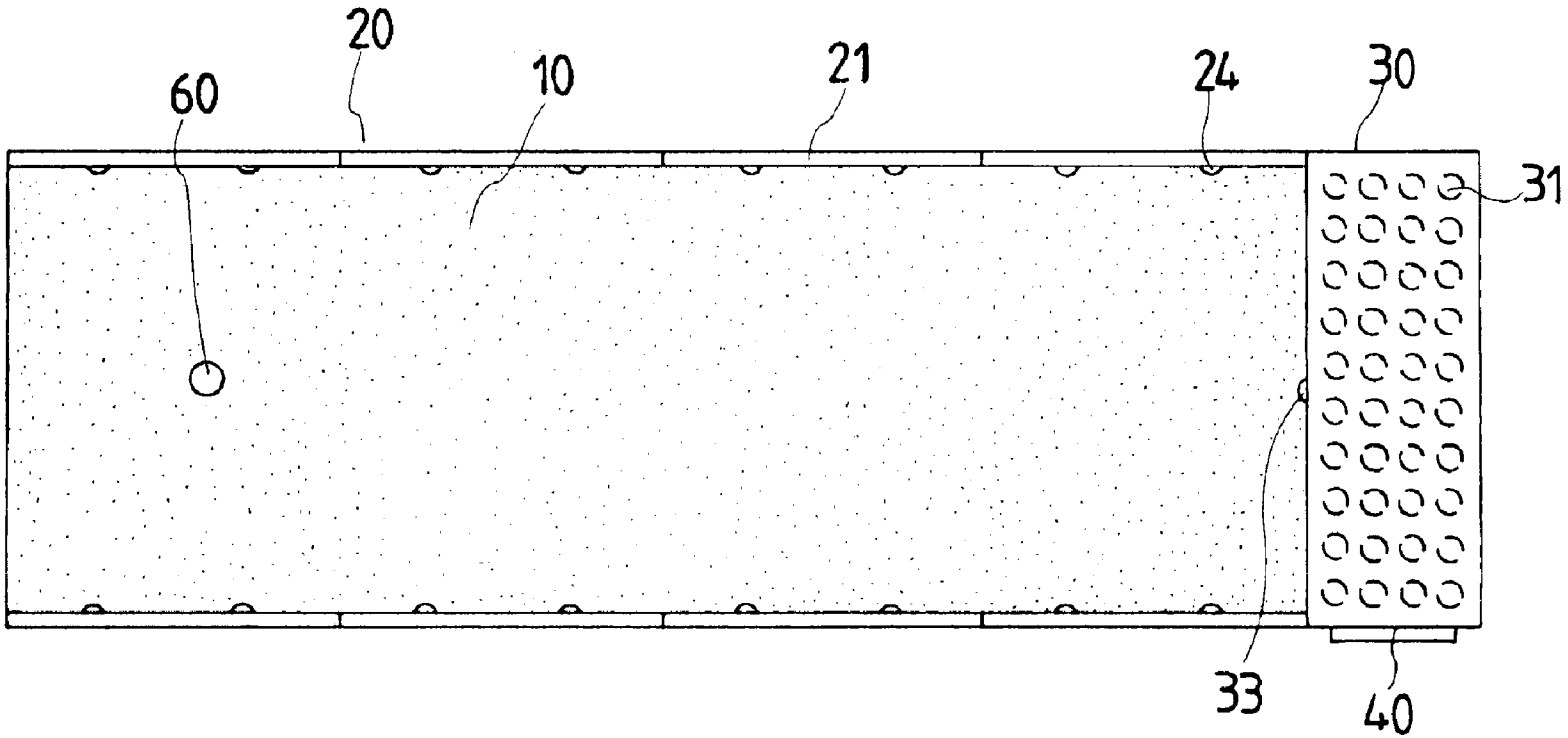
FIG. 5 is a top view to show the sections of each of the two side walls of the present invention.

Referring to FIGS. 2 to 5, the golf putting teaching device of the present invention comprises a path 10 which has a start end and a target end which can be made to have proper slope just like a green. Two side walls 20 are located on two sides of the path 10 and each side walls 20 is composed of a plurality of sections 21. Each section 21 has at least one first sensor 24 connected thereto which has wires 28 extending to two ends of each section 21. The first sensors 24 are located at an inside of each section 21 so as to detect the ball on the path 10. Each section 21 has a male connector 23 on one end and a recess 22 defined in the other end. Each recess 22 includes a terminal piece 25 for being engaged with the male connector 23 such that the sections 21 are connected with each other to form a straight side wall by inserting the male connector 23 into the recess 22 of the next section 21.

An end piece 30 has a top board 34 and two side portions 35, 36. The end piece 30 is mounted across two sides of the path 10 and a plurality of second sensors 31 are located on an underside of the top board 34. The two side portions 35, 36 each have a recess 32 with a terminal piece 320 therein so as to be connected to the male connector 23 of the sections 21 on an end of each of the two side walls 20. The first sensors 24 in the side walls 20 are electronically connected to the second sensors 31 of the top board 34. The second sensors 31 on the top board 34 cover a target area of the path 10 and an index 33 is connected to a front surface of the top board 34 such that the player may aim the index 33 to putt the ball (not shown).

A controlling device 40 is connected to one of the tow side portions 35, 36 and electronically connected to the first and the second sensors 24, 31. The controlling device 40 has a micro-processor and programmable control programs therein. Accordingly, data that the first and the second sensors 24, 31 are collected and calculate in the controlling device 40 and displayed on a display device which is not shown. By this way, the player know how the putt is played.

Figure 6:
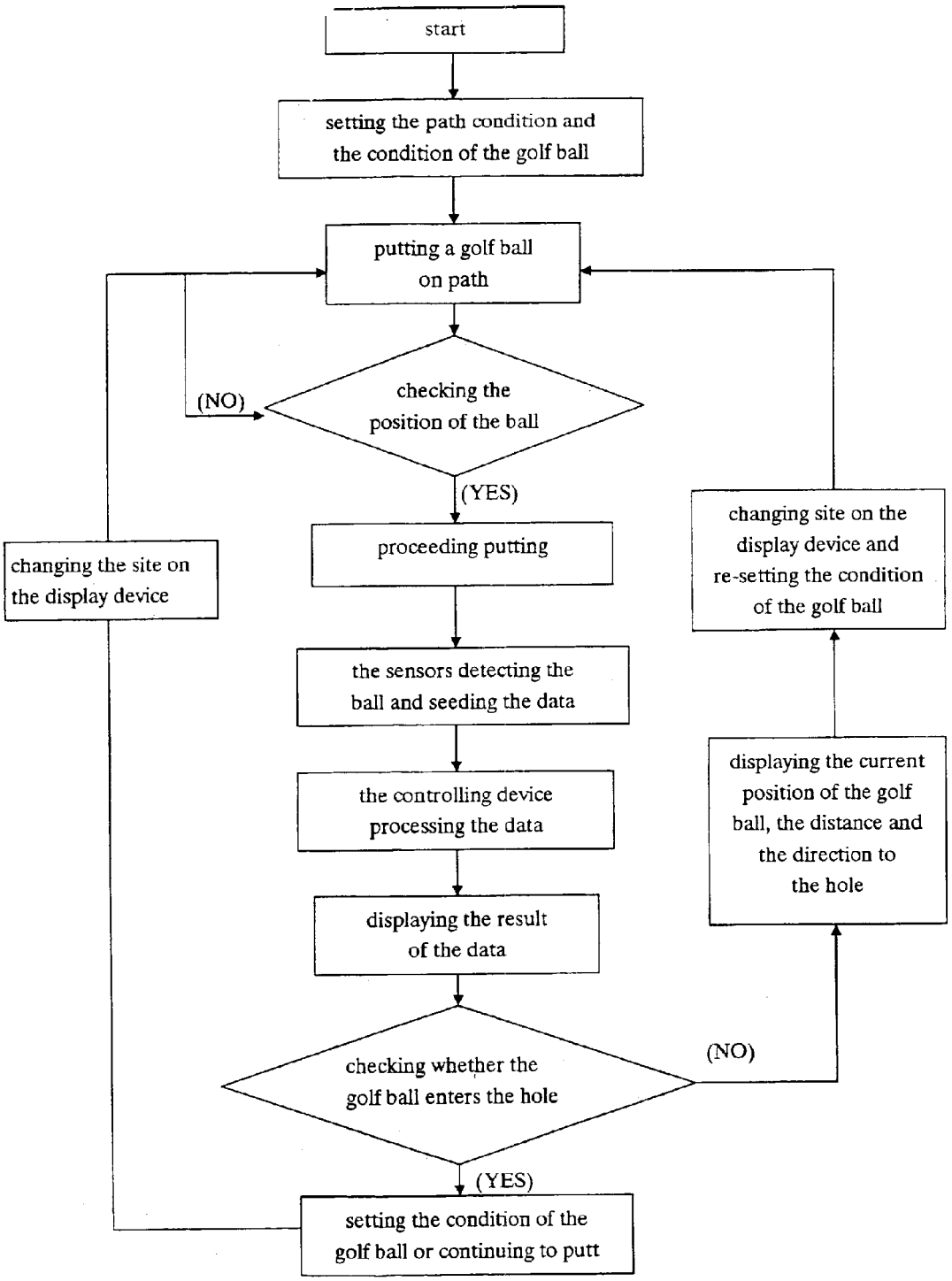
FIG. 6 shows the programmable steps of the controlling device of the present invention.

As shown in FIG. 6, the controlling device 40 may proceed the following steps:

step 1: start;

step 2: setting the path condition and the condition of the golf ball;

step 3: putting a golf ball on the path;

step 4: checking the position of the ball, if yes, go to step 5, if no, go to step 3;

step 5: proceeding putting;

step 6: the first and the second sensors 24, 31 detecting the ball and sending the data to the controlling device 40;

step 7: the controlling device 40 processing the data;

step 8: displaying the result of the data;

step 9: checking whether the golf ball enters the hole, if yes, go the step 10, if no, go to step 12;

step 10: setting the condition of the golf ball or continuing to putt;

step 11: changing the site on the display device;

step 12: displaying the current position of the golf ball, the distance and the direction to the hole;

step 13: changing site on the display device and re-setting the condition of the golf ball, and then go to step 3.

Figure 7:
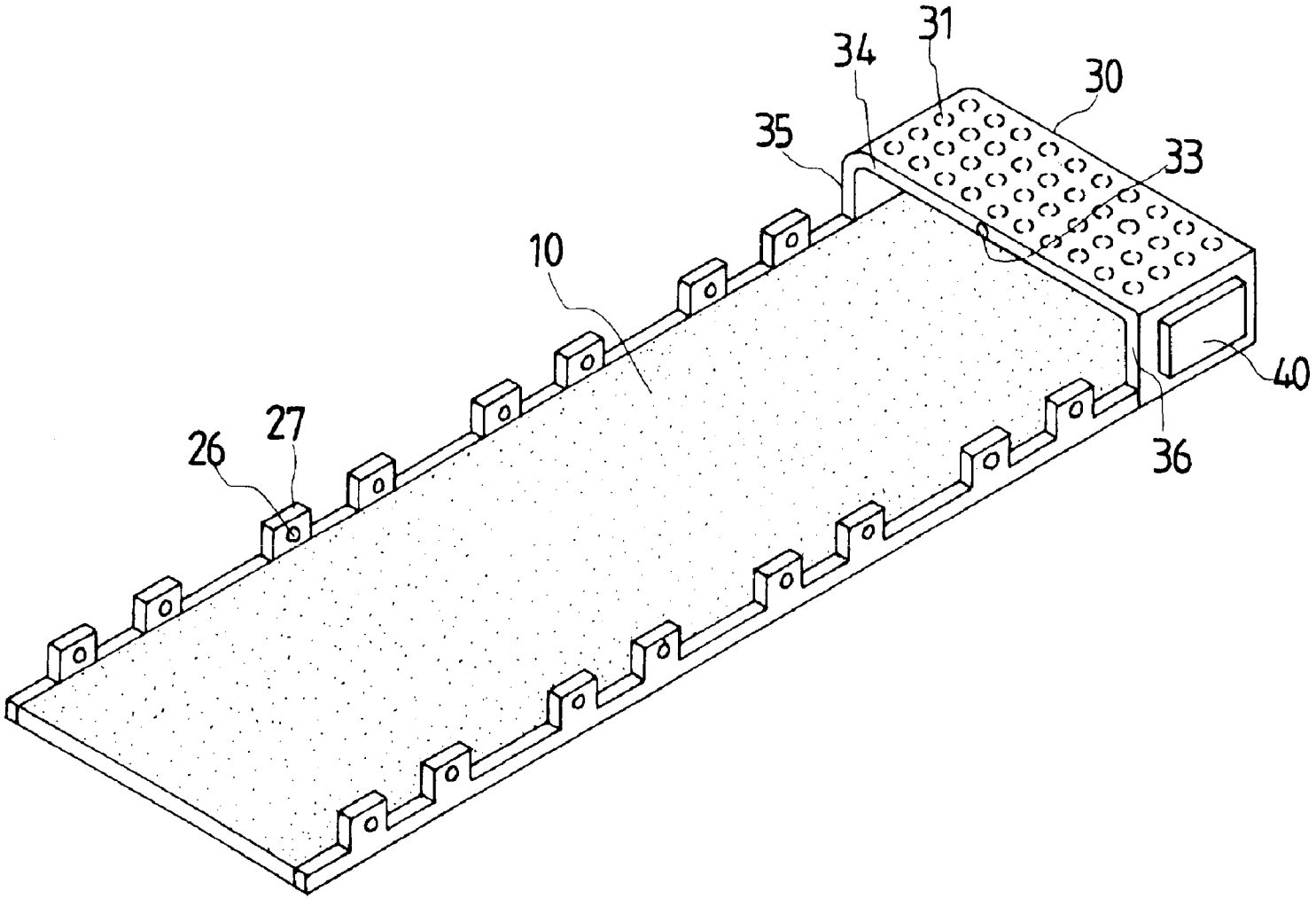
FIG. 7 shows another embodiment of the side walls of the golf putting teaching device of the present invention.

FIG. 7 shows that the side walls can also be made by several protrusions 27 along the two sides of the path 10 and each protrusion 27 has a first sensor 26 on an inside thereof.

While we have shown and described the embodiment in accordance with the present invention, it should be clear to those skilled in the art that further embodiments may be made without departing from the scope of the present invention.

What is claimed is:

1. A golf putting teaching device comprising:

a path;

two side walls located on two sides of the path and each of the two side walls composed of a plurality of sections, each section having at least one first sensor connected thereto which has wires extending to two ends of each section, each section having a male connector on one end and a recess defined in the other end such that the sections are connected to each other by inserting the male connector into the recess of the next section, and an end piece having a top board and two side portions, the end piece mounted across two sides of the path and a plurality of second sensors located on an underside of the top board, the first sensors in the side walls being electronically connected to the second sensors of the top board.

2. The device as claimed in claim 1, wherein each of the two side portions has a recess so as to be connected to the mate connector of the sections on an end of each of the two side walls.

3. The device as claimed in claim 1, wherein the second sensors on the top board cover a target area of the path.

4. The device as claimed in claim 1, wherein an index is connected to a front surface of the top board.

5. The device as claimed in claim 1 further comprising a controlling device connected to one of the tow side portions and electronically connected to the first and the second sensors.

* * * * *